United States Patent [19]

Sakai et al.

[11] 4,114,373

[45] Sep. 19, 1978

[54] INTERNAL COMBUSTION ENGINE HAVING SIAMESED EXHAUST PORTS AND AN AFTERCOMBUSTION CHAMBER

[75] Inventors: Yasuo Sakai, Yokohama; Yasuhiko Nakagawa, Kamakura; Yasuo Nakajima, Yokosuka, all of Japan

[73] Assignee: Nissan Motor Company, Limited, Japan

[21] Appl. No.: 676,664

[22] Filed: Apr. 14, 1976

[30] Foreign Application Priority Data

Apr. 15, 1975 [JP] Japan ..... 50/45554

[51] Int. Cl.[2] ..... F01N 3/10

[52] U.S. Cl. ..... 60/282; 60/323; 123/193 H

[58] Field of Search ..... 60/282, 323; 123/191 A, 123/193 H

[56] References Cited

U.S. PATENT DOCUMENTS

| | | | |
|---|---|---|---|
| 2,257,631 | 9/1941 | Wahlberg | 60/323 |
| 3,413,803 | 12/1968 | Rosenlund | 60/282 |
| 3,577,727 | 5/1971 | Warren | 60/282 |
| 3,965,881 | 6/1976 | Sakurai | 60/282 |

FOREIGN PATENT DOCUMENTS

| | | | |
|---|---|---|---|
| 2,323,793 | 11/1974 | Fed. Rep. of Germany | 60/282 |

*Primary Examiner*—Douglas Hart

[57] ABSTRACT

Siamesed exhaust ports are formed in an engine cylinder head and contain therein port liners. An exhaust manifold has therein an aftercombustion chamber which is enclosed by a heat insulator and communicates with the siamesed exhaust ports thereby preventing reduction of temperature of the exhaust gases admitted into an exhaust manifold from the engine. Thus, sufficient oxidation of the combustible compounds in the exhaust gases is achieved in the aftercombustion chamber of the exhaust manifold.

11 Claims, 11 Drawing Figures

INTERNAL COMBUSTION ENGINE HAVING SIAMESED EXHAUST PORTS AND AN AFTERCOMBUSTION CHAMBER

The present invention relates in general to an internal combustion engine and more particularly to an ignition type internal combustion engine equipped with an afterburning apparatus at the exhaust system thereof.

Some modernized ignition type internal combustion engines are equiped with exhaust manifolds which form therein aftercombustion chambers in order to completely burn out predetermined kinds of harmful compounds such as hydrocarbons (HC) and carbon monoxide (CO) in the exhaust gases before the exhaust gases are discharged to the open air.

In these kinds of engines, it has been common that the exhaust gas feed from the combustion chambers of the engine into the aftercombustion chamber is made by suitable numbers of passages each of which consists of an exhaust port communicable with one of combustion chambers of the engine, and an inlet tube of the exhaust manifold. Thus, the exhaust gases are caused to be considerably cooled by heat loss by radiation during their travelling in the above-mentioned relatively elongated passages thereby causing the combustion of the exhaust gases in the after-combustion chamber of the exhaust manifold insufficient.

Therefore, the present invention contemplates provision of an improved internal combustion engine system which can obviate the drawbacks encountered in the prior art engine system as mentioned.

It is an object of the present invention to provide an improved internal combustion engine which has an exhaust system operable to effectively complete combustion of the remaining combustible compounds such as hydrocarbons (HC) and carbon monoxide (CO) contained in the exhaust gases issued from the combustion chambers of the engine.

It is another object of the present invention to provide an improved internal combustion engine system which has an exhaust system operable to prevent the reduction of temperature of the exhaust gases admitted into an exhaust manifold from the engine thereby causing sufficient oxidation of the combustible compounds contained in the exhaust gases fed into the exhaust system.

It is still another object of the present invention to provide an internal combustion engine having a cylinder head formed with siamesed exhaust ports each of which is communicable with two combustion chambers neighboring to each other.

It is a further object of the present invention to provide the siamesed exhaust ports which are equipped therein with port liners for more effectively achieving heat insulation in the siamesed exhaust ports.

It is a further object of the present invention to provide the exhaust manifold which has therein an exhaust manifold liner for achieving more effective heat insulation in the manifold to complete combustion of the remaining combustible compounds in the exhaust gases.

The other objects and advantages of the present invention will become more apparent from the following detailed description when taken in conjunction with the accompanying drawings in which.

Figure 1:
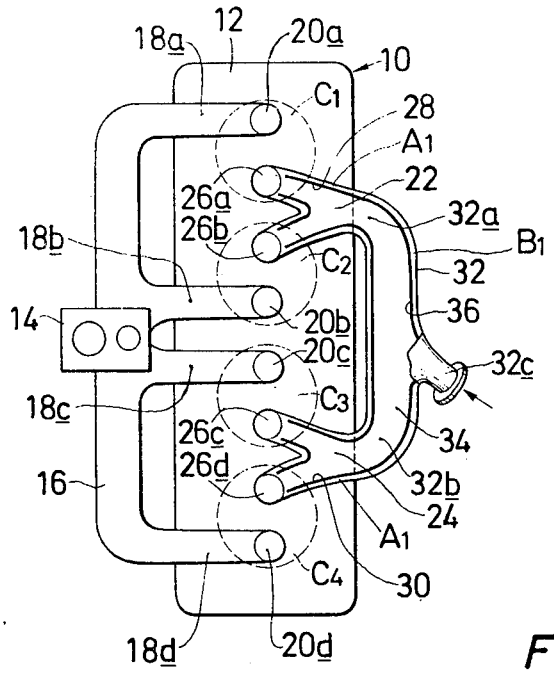
FIG. 1 is a sketch of a first preferred embodiment of an internal combustion engine system according to the present invention.

Referring now to FIG. 1 of the drawings, there is shown a preferred embodiment of a spark ignition type internal combustion engine according to the principal of the present invention, in which the engine is generally designated by the reference numeral 10.

The engine 10 has, in this instance, four combustion chambers $C_1$ to $C_4$ each of which consists of an upper portion of a cylinder bore formed in the cylinder block (no numeral) and a recess formed in a cylinder head 12. The engine 10 is equipped with a carburetor 14 or air-fuel supply means which communicates through an intake manifold 16, intake ports 18*a* to 18*d* and intake valves 20*a* to 20*d* with the combustion chambers $C_1$ to $C_4$, as shown.

In the cylinder head 12 of the engine 10 are formed with two siamesed exhaust ports 22 and 24, in which the port 22 communicates with a first group of the combustion chambers $C_1$ and $C_2$ through exhaust valves 26*a* and 26*b* respectively, and the port 24 communicates with a second group of the combustion chambers $C_3$ and $C_4$ through respective exhaust valves 26*c* and 26*d*.

Figure 2:
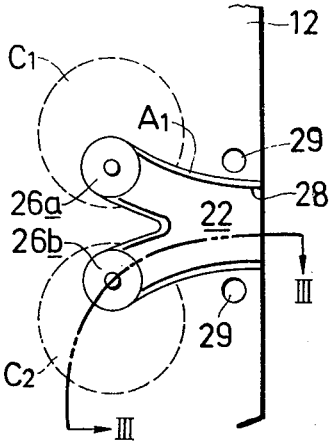
FIG. 2 is an enlarged view of a siamesed exhaust port shown in FIG. 1.
Figure 3:
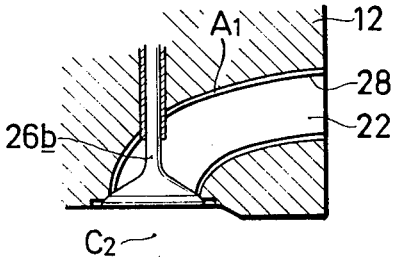
FIG. 3 is a sectional view taken substantially along the line III—III of FIG. 2.

Within the siamesed exhaust ports 22 and 24 are disposed respective port liners 28 and 30 which are made of metal plates and are arranged to define a layer of air $A_1$ between the inner surfaces of these ports 22, 24 and the outer surfaces of these port liners 28 and 30 as best seen in FIGS. 2 and 3. As seen in FIG. 2, suitable numbers of bolt holes 29 are formed in the cylinder head 12 besides the siamesed exhaust port 22 (24) for receiving therein fastening bolts to fasten the cylinder head 12 to the cylinder block.

An exhaust manifold 32 having an aftercombustion chamber 34, two inlet openings 32*a*, 32*b* and an outlet duct 32*c* is fixed to the cylinder head 12 by suitable fastening means in such a manner that the two inlet openings 32*a* and 32*b* incorporate with the respective siamesed exhaust ports 22 and 24 are shown in FIG. 1.

Within the exhaust manifold 32 is disposed an exhaust manifold liner 36 which is made of a metal plate and is spaced apart from the inner surface of the exhaust manifold 32 so as to define a layer of air $B_1$ between the liner 36 and the exhaust manifold 32.

With the above-stated characteristic construction of the engine system of the present invention, the heat loss of the exhaust gases travelling along within the siamesed exhaust ports 22 and 24 is remarkably reduced by the addition of the port liners 28 and 30. In addition, since the exhaust manifold 32 is provided with the exhaust manifold liner 36 acting as a heat insulator, the reduction of temperature of the exhaust gases admitted from the siamesed exhaust ports 22 and 24 into the aftercombustion chamber 34 is prevented preferably to cause sufficient oxidation of the remaining combustible compounds of the exhaust gases in the aftercombustion chamber 34.

Figure 4:
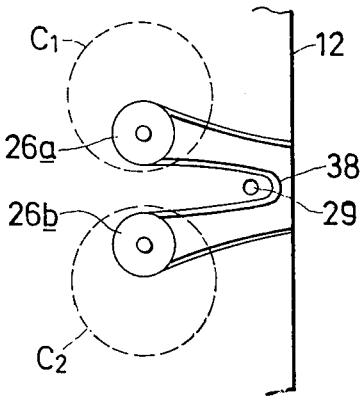
FIGS. 4 and 5 are views similar to FIG. 2, showing modified forms of the siamesed exhaust ports.
Figure 5:
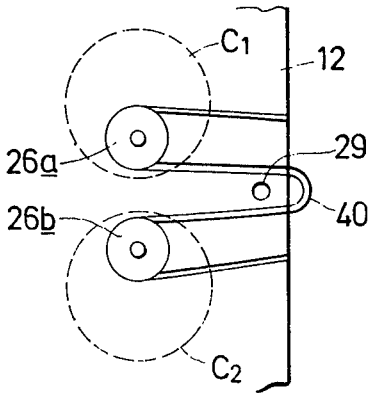

FIGS. 4 and 5 show modified forms of the siamesed exhaust ports, in which FIG. 4 is one of the forms with junction portion 38 near the side edge of the cylinder head 12 and FIG. 5 is another form with the junction portion 40 positioned in an inlet opening 32*a* (32*b*) of the exhaust manifold 32. By forming the siamesed exhaust ports in the above-mentioned manner, it is possible to fasten the cylinder head 12 to the cylinder block by using reduced numbers of bolts.

Figure 6:
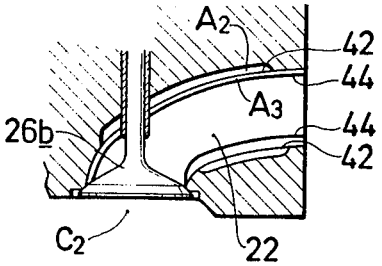
FIGS. 6 and 7 are sectional views of the siamesed exhaust ports equipped with port liners.

FIG. 6 shows a modified form of the port liner disposed in the siamesed exhaust ports 22 (24), in which the port liner is formed into a double liner consisting of an outer liner 42 and an inner liner 44. The liners 42 and 44 are arranged to define a first layer of air $A_2$ and a second layer of air $A_3$ between the inner surface of the port 22 and the outer surface of the outer liner 42, and the inner surface of the outer liner 42 and the outer surface of the inner liner 44, respectively, as shown. The formation of these port liners 42 and 44 in the siamesed exhaust ports 22 (24) is made during the casting process of the cylinder head 12.

By the provision of these arrangements of the port liners 42 and 44, more increased heat insulating effect is achieved in the siamesed exhaust ports 22 and 24.

Figure 7:
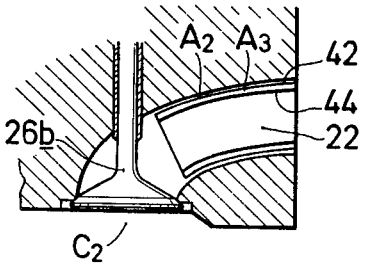

FIG. 7 shows another modified form of the port liner in the siamesed exhaust port 22 (24), in which an unit of an outer liner 42′ and an inner liner 44′ is inserted into the port 22 (24) from the outside of the cylinder head 12. By employing such way, the formation of the double liner arrangement in the siamesed exhaust ports 22 (24) is readily made.

Figure 8:
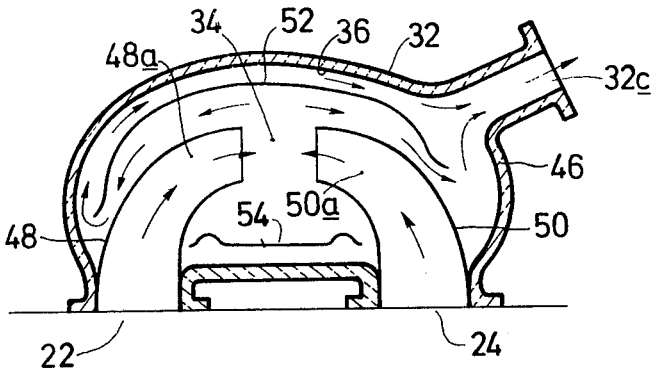
FIGS. 8 to 10 are sketchs of modified forms of exhaust manifolds equipped therein with exhaust gas guide means.

FIG. 8 shows a modified form of the exhaust manifold 32, in which a heat insulating material 46 such as glass wool is filled in a clearance defined by the exhaust manifold 32 and the exhaust manifold liner 36. Further, in this modification, two guide tubes 48 and 50 respectively having curved outlet portions 48*a* and 50*a* facing to each other are disposed in the exhaust manifold 32 so as to communicate with the siamesed exhaust ports 22 and 24 respectively. In addition, two guide plates 52 and 54 are arranged in the manifold 32 so as to considerably space apart from the inner surface of the exhaust manifold 32 as shown. With these arrangements, a preferable circulation of the exhaust gases is achieved within the aftercombustion chamber 34 while being kept at an increased temperature thereby achieving complete combustion of the remaining combustible compounds in the exhaust manifold 32.

Figure 9:
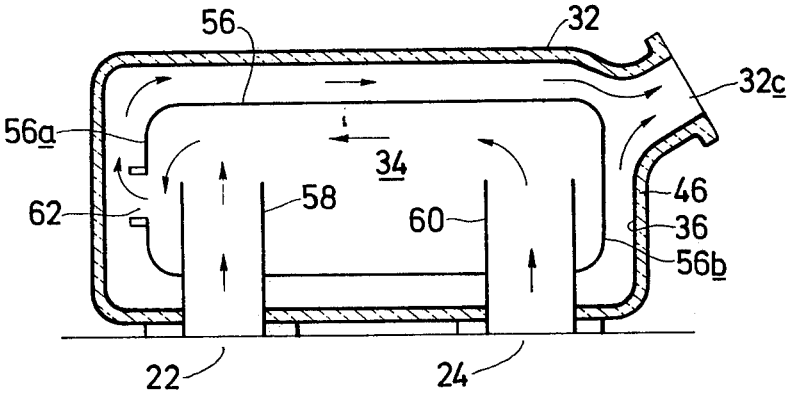

FIG. 9 shows another modified form of the exhaust manifold 32. In this modification, an inner casing 56 having two inlet tubes 58, 60 and an outlet opening 62 is disposed in the exhaust manifold 32 so as to define a certain clearance between the outer surface of the inner casing 56 and the inner surface of the exhaust manifold liner 36. The inlet tubes 58 and 60 are connected at the upstream portions thereof to the siamesed exhaust ports 22 and 24 respectively and extend at the downstream portions thereof into the inner casing 56 as shown. The outlet opening 62 is positioned in an end wall 56*a* opposite another end wall 56*b* adjacent the outlet duce 32*c* of the exhaust manifold 32. With this construction of the exhaust manifold 32, a certain amount of holding time of the exhaust gases in this manifold 32 is achieved, so that more effective aftercombustion of the combustible compounds is obtained.

Figure 10:
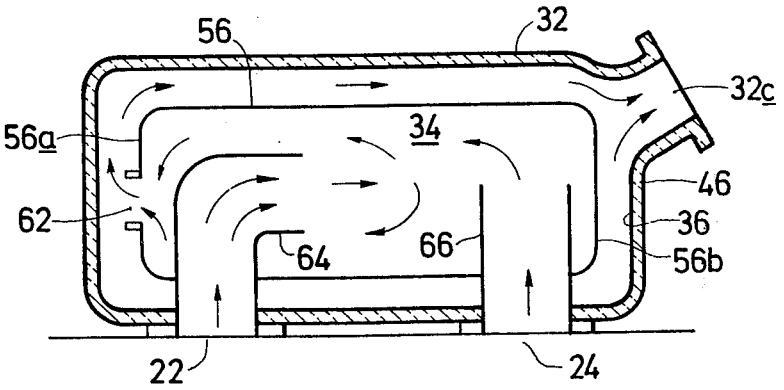

FIG. 10 shows still another modified form of the exhaust manifold 32, in which the manifold 32 comprises generally same parts as in the case of FIG. 9 with the exception of the intake tube 64. In this modification, the intake tube 64 is bent at the downstream portion thereof toward the other intake tube 60 as shown. By this arrangement, the holding time of the exhaust gases, in the exhaust manifold 32, admitted from the intake tube 64 becomes generally same as that from the other inlet tube 66. Accordingly, more effective aftercombustion is achieved in this case.

It is now to be noted that the guide or inlet tubes 48, 50 (FIG. 8), 58, 60, 64 and 99 (FIGS. 9 and 10) may be so constructed to have therein respective liners for allowing the aftercombustion chambers of the exhaust manifold 32 to perform more effective combustion efficiency.

Figure 11:
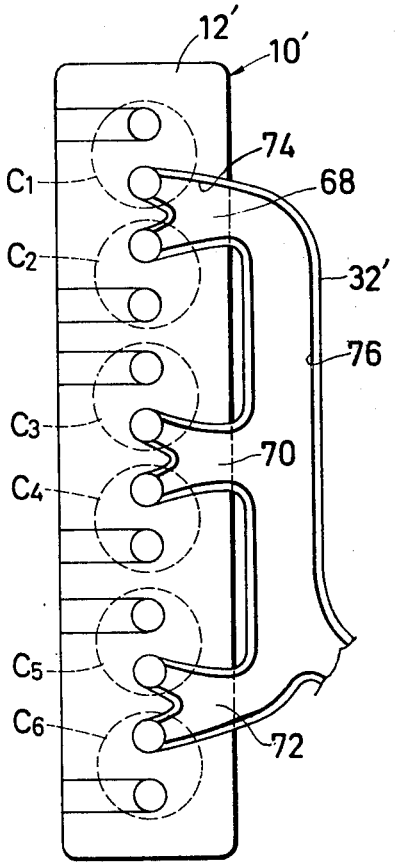
FIG. 11 is a sketch of a second preferred embodiment of an internal combustion engine according to the present invention.

FIG. 11 shows another preferred embodiment according to the present invention, in which an engine 10′ includes six combustion chambers $C_1$ to $C_6$. In this embodiment, the cylinder head 12′ of the engine 10′ has therein three siamesed exhaust ports 68, 70 and 72 respectively communicable with a first group of combustion chambers $C_1$ and $C_2$, a second group of combustion chambers $C_3$ and $C_4$, and a third group of combustion chambers $C_5$ and $C_6$. Port liners 74 and exhaust manifold liners 76 are also provided in the siamesed exhaust ports 68, 70 and 72, and the exhaust manifold 32′ in a similar way to the first embodiment shown in FIG. 1.

It is now to be noted that if the engine is of a type operated on an air-fuel mixture leaner than stoichiometric (such as an torch ignition internal combustion engine), it is unnecessary to feed any additional air to the exhaust gases admitted into the aftercombustion chamber of the exhaust manifold since the gases from the combustion chambers of such kind engine contain therein a certain amount of oxygen to burn out the remaining combustible compounds in the exhaust gases. However, if the engine is of a type operated on an air-fuel mixture richer than stoichiometric, suitable additional air supply means is required since the exhaust gases from this kind engine certain therein almost no oxygen.

Although, in the previous description of the present invention, only several embodiments have been shown and described, the invention is not limited to the desclosed embodiments but is defined by the following claims.

What is claimed is:

1. An internal combustion engine comprising:

a cylinder block;

a cylinder head positioned atop said cylinder block to define therebetween two combustion chambers which are respectively communicable with two exhaust port passages opening to the atmosphere at one side of said cylinder head, said exhaust port passages being arranged to neighbour each other;

a bolt member fastening said cylinder head to said cylinder block by passing through a bolt hole which is formed in said cylinder head at a position between said two exhaust port passages near one side of said cylinder head;

exhaust port liner means covering the surface of each exhaust port passage for preventing temperature drop of the exhaust gases passing therethrough;

an exhaust manifold having inlet and outlet openings which are fluidly communicated with an aftercombustion chamber formed in said manifold, said inlet opening being connected to both of said two exhaust port passages so as to introduce the exhaust gases emitted from said combustion chambers into said aftercombustion chamber for re-combustion of the same; and an exhaust manifold liner covering the inner surface of said exhaust manifold for preventing temperature drop of the exhaust gases passing therethrough.

2. An internal combustion engine as claimed in claim 1, in which said two exhaust port passages are united at a position near said one side of said cylinder head to form a siamesed exhaust port passage.

3. An internal combustion engine as claimed in claim 1, in which said exhaust port liner means comprises a generally tubular first member disposed in said exhaust port passage so as to be spaced apart from the surface of said exhaust port passage for defining a clearance between the outer surface of said first member and the surface of said exhaust port passage.

4. An internal combustion engine as claimed in claim 3, in which said exhaust port liner means further comprises a generally tubular second member disposed in said first member so as to be spaced apart from the inner surface of said first member for defining a clearance between the outer surface of said second member and the inner surface of said first member.

5. An internal combustion engine as claimed in claim 1, further comprising a heat insulating member which is filled into a clearance defined the outer surface of said exhaust manifold liner and the inner surface of said exhaust manifold.

6. An internal combustion engine as claimed in claim 5, further comprising exhaust gas guide means which is disposed in said exhaust manifold for allowing the exhaust gases admitted into the aftercombustion chamber in said exhaust manifold to have a certain amount of resident time in said aftercombustion chamber.

7. An internal combustion engine comprising:

a cylinder block;

a cylinder head positioned atop said cylinder block to define therebetween four aligned combustion chambers which are respectively communicable with four exhaust port passages opening to the atmosphere at one side of said cylinder head, two of said four exhaust port passages being arranged to neighbour each other and the other two of the same being arranged to neighbour each other;

a bolt member fastening said cylinder head to said cylinder block by passing through a bolt hole which is formed in said cylinder head at a position between the neighbouring two of said four exhaust port passages and near said one side of said cylinder head;

exhaust port liner means covering the surface of each of said exhaust port passages for preventing temperature drop of the exhaust gases passing therethrough;

an exhaust manifold having two inlet openings and an outlet opening which are fluidly communicated with an aftercombustion chamber formed in said manifold, said two inlet openings being respectively connected to said two and the other two exhaust port passages so as to introduce the exhaust gases emitted from the combustion chambers into said aftercombustion chamber for re-combustion of the same; and an exhaust manifold liner covering the inner surface of said exhaust manifold for preventing temperature drop of the exhaust gases passing therethrough.

8. An internal combustion engine as claimed in claim 7, in which said two and the other two of said exhaust port passages are respectively united at positions near said one side of said cylinder head to form two siamesed exhaust port passages.

9. An internal combustion engine as claimed in claim 8, further comprising exhaust gas guide means which is disposed in said exhaust manifold for allowing the exhaust gases admitted into said aftercombustion chamber to have certain amount of resident time in said chamber.

10. An internal combustion engine as claimed in claim 9, in which said exhaust gas guide means comprises:

two guide tubes having respective inlet openings respectively connected to said two siamesed exhaust port passages, and respective outlet openings open into a manifold; and a guide plate disposed in said exhaust manifold so as to surround said two guide tubes while spacing apart from the inner surface of said exhaust manifold.

11. An internal combustion engine as claimed in claim 10, in which said two guide tubes are smoothly bent at the downstream portions thereof so that the outlet openings thereof face to each other.

* * * * *